US006767331B2

(12) United States Patent
Stouffer et al.

(10) Patent No.: US 6,767,331 B2
(45) **Date of Patent: *Jul. 27, 2004**

(54) BACKLOAD FLUIDIC SWITCH WITH IMPROVED PRESSURE RECOVERY

(75) Inventors: Ronald D. Stouffer, Silver Spring, MD (US); Gregory A. Russell, Baltimore, MD (US); Aland Santamarina, Columbia, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 133 days.

This patent is subject to a terminal disclaimer.

(21) Appl. No.: 09/982,085

(22) Filed: Oct. 19, 2001

(65) Prior Publication Data

US 2002/0052567 A1 May 2, 2002

Related U.S. Application Data

(60) Provisional application No. 60/241,791, filed on Oct. 20, 2000.

(51) Int. Cl.[7] ..... A61H 7/00
(52) U.S. Cl. ..... 601/150; 601/148; 137/806
(58) Field of Search ..... 601/148, 149, 601/150, 151, 152; 137/805, 806, 826, 829, 833, 834, 836, 840, 803; 128/DIG. 10, DIG. 20; 5/173

(56) References Cited

U.S. PATENT DOCUMENTS

| | | | | | |
|---|---|---|---|---|---|
| 3,390,674 | A | * | 7/1968 | Jones | 601/150 |
| 3,563,259 | A | * | 2/1971 | Jones | 137/805 |
| 3,623,497 | A | | 11/1971 | Kaske | 137/81.5 |
| 3,734,116 | A | * | 5/1973 | Trask, II | 137/836 |
| 3,811,431 | A | | 5/1974 | Apstein | 128/64 |
| 3,896,794 | A | | 7/1975 | McGrath | 128/24 R |
| 4,258,753 | A | * | 3/1981 | Limpaecher | 137/806 |
| 4,278,110 | A | | 7/1981 | Price et al. | 137/805 |
| 5,109,832 | A | | 5/1992 | Proctor et al. | 128/24 R |
| 5,701,622 | A | | 12/1997 | Biggie et al. | 5/713 |
| 6,240,945 | B1 | | 6/2001 | Srinath et al. | 137/14 |
| 6,572,570 | B1 | * | 6/2003 | Burns et al. | 601/148 |

OTHER PUBLICATIONS

*A Methodological Approach to the Design Optimization of Fluidic Elements*, PR I, Proceedings of the Sixth Cranfield Fluidics Conference, 1974.

*Proportional Fluidic Amplification Using a Free Liquid Jet*, PR II, Proceedings of the Sixth Cranfield Fluidics Conference, 1974.

*A Pure Fluidic Circuit Applied for a Fluid Division Ratio Control in a Distiller Column*, PR III, Proceedings of the Sixth Cranfield Fluidics Conference, 1974.

* cited by examiner

*Primary Examiner*—Michael A. Brown
*Assistant Examiner*—Quang D. Thanh
(74) *Attorney, Agent, or Firm*—Jim Zegeer

(57) ABSTRACT

A backload-responsive fluidic switch having high pressure recovery of more than 50% comprises a body member with a power nozzle having a width W and a centerline CL which is adapted to be coupled to a source of fluid under pressure for issuing a jet of fluid along the centerline. A pair of diverging fluid flow passages have a common connection with the power nozzle and respective bounding walls, each respective bounding wall diverging from the centerline no more than about 50°, and a splitter defining respective inner walls of the pair of diverging walls, the splitter being spaced a distance of about 3W from the power nozzle. Inflatable bladder(s) connected to the diverging fluid flow passage(s), and a vent connected to the other of said fluid flow passages.

11 Claims, 9 Drawing Sheets

| dim | R&D | R&D / Pw |
|---|---|---|
| | m14846-000.19 | m14846-000.19 |
| | (in) | |
| Pw= | 0.021 | 1.00 |
| Cd= | 0.028 | 1.33 |
| $Lw_b$= | 0.042 | 2.00 |
| $Lw_u$= | 0.042 | 2.00 |
| Sw= | 0.087 | 4.14 |
| Vw= | 0.027 | 1.29 |
| $Pv_L$= | 0.315 | 15.00 |
| $Sv_L$= | 0.148 | 7.05 |
| $\phi$Pv = | 0.137 | 6.52 |
| $\phi$Sv = | 0.098 | 4.67 |

| dim | (deg) |
|---|---|
| $\alpha$ = | 14.2 |
| $\beta$ = | 42.8 |
| $\gamma$= | 1.0 |

BACKLOAD FLUIDIC SWITCH WITH IMPROVED PRESSURE RECOVERY

REFERENCE TO RELATED APPLICATIONS

The present application is the subject of provisional application Serial No. 60/241,791 filed Oct. 20, 2000 and entitled BACKLOADED FLUIDIC SWITCH WITH IMPROVED PRESSURE RECOVERY. This application is also related to application Ser. No. 09/567,890 filed May 20, 2000 for FLUIDIC PULSE GENERATOR AND MASSAGER AND METHOD and is also related to U.S. application Ser. No. 09/773,631 filed Feb. 2, 2001 and entitled BACKLOAD RESPONSIVE FLUIDIC PULSE SWITCH AND MEDICAL MATTRESS, now abandoned

BACKGROUND AND BRIEF DESCRIPTION OF THE INVENTION

The present invention relates to fluidic pulse generator devices, particularly a backload-responsive fluidic switch having high pressure recovery, and still more particularly to a backload-responsive fluidic switch having high pressure recovery for driving flexible bladders and massaging apparatus.

In PCT international application No. PCT/US00/06702 published May 11, 2000, a crossover-type fluidic switching element of the type shown in FIG. 1 is utilized. In such a construction, the power jet in the interaction region deflects but a fraction of that of the normal oscillating mode (without backloading). So small was this deflection that it was thought that the alternate inflation/deflation of two bladders (one on each of the two receivers) could be accomplished with an ordinary Y- or T-connector. It proved not to be the case. A large model of the crossover-type switching element was tested using water with tracer dye introduced in the power nozzle and again showed unusually small deflections in the interaction region as the receiver flow switches in correspondence to backloading. However, when a normal crossover-type element with two receivers was modified by eliminating or machining away the portion that contained the power nozzle and control channels and most of the interaction area. The remaining fragment of the original silhouette was tested with two bladders with the same result as the original unit with blocked control ports. Thus, it is believed that the major control centers about the bistable nature of the system is in the receiver geometry.

Accordingly, the present invention is directed to a backload-responsive fluidic switch having high pressure recovery. According to the invention, a fluidic switch having a relatively high pressure recovery (greater than 50%) is constituted by a power nozzle, projecting a jet of fluid towards a splitter, the splitter defining a pair of receiver channels or diverging flow paths. The diverging flow paths from the splitter have a common connection with the power nozzle and have respective bounding walls. Each respective bounding wall diverging from the centerline through the power nozzle no more than about 50°. The splitter defines respective inner walls of the diverging channels or flow paths, with the splitter being spaced a distance of about 3W (W being the width of the power nozzle) from the power nozzle. At least one vent is connected to one of the fluid flow passages.

In one embodiment, an inflatable bladder is connected to one of the diverging fluid flow passages and a vent is connected to the other fluid flow passages. Thus, when a jet of fluid is issued through the power nozzle, the jet of fluid forms a first coanda attachment bubble on the bounding wall leading to the inflatable bladder, thereby increasing the pressure in the bladder and strengthening the coanda attachment bubble. After the first fluid pressure in the bladder reaches a set load or level, the first coanda attachment bubble forces the jet to the switch to the opposite output passage. In the case of a single bladder, the jet is switched to an output leg with its own attachment bubble and a vent. Entrainment in the output leg starts to lower the pressure in the bag enough for the jet to switch back to the output channel having the bladder attached to it and the cycle repeats. In this embodiment, structurally the jet is biased to the output with the bladder attached.

In a second embodiment, a two-bag or bladder version is disclosed. In the two-bag embodiment, the fluidic switch has relatively high pressure recovery (more than 50%) and is constituted by a power nozzle projecting a jet of fluid towards a splitter with the splitter defining a pair of receiver channels. A pair of attachment walls are provided adjacent the power nozzle and a pair of vents is provided adjacent the attachment walls, one vent for each of the respective output channels of the fluidic switch. Thus, switching of the jet of fluid back and forth between the receiver channels is caused when the backload in each receiver channel overcomes the wall attachment at its associated attachment wall. In other words, the operation is similar to the one-bag version except in the one-bag version the biased start-up conditions is provided.

The invention features a backload-responsive fluidic switch having high pressure recovery of more than 50% comprising a body member having a power nozzle having a width W and a centerline CL, said power nozzle being adapted to be coupled to a source of fluid under pressure for issuing a jet of fluid along said centerline, a pair of diverging fluid flow passages having a common connection with the power nozzle and respective bounding walls, each respective bounding wall diverging from the power nozzle centerline no more than about 50°, and a splitter defining respective inner walls of said pair of diverging walls, said splitter being spaced a distance of about 3W from said throat. An inflatable bladder is connected to one of the diverging fluid flow passages, and a vent connected to the other of the fluid flow passages.

The backload-responsive fluidic switch defined above further features a pair of inflatable bladders, one connected to each of the diverging flow passages, respectively, and, wherein there is a vent connected to each of the fluid flow passages downstream of said power nozzle, the bounding wall portions between said power nozzle and each vent constituting coanda attachment walls, respectively.

Further, on one embodiment of the backload-responsive fluidic switch defined above, the power nozzle centerline is offset or structurally biased relative to the one of said diverging fluid flow passages to which said inflatable bladder is connected.

Still further, the backload-responsive fluidic switch defined above, the vent(s) is connected to the flow passage(s) a selected distance (beyond the coanda bubble, but as close to the bubble as possible, to achieve high pressure recovery) from the power nozzle and the portion of the bounding wall from the power nozzle to said vent constitutes a coanda attachment wall.

Finally, in the backload-responsive fluidic switch defined above, when a jet is issued through the power nozzle, the jet of fluid forms a first coanda attachment bubble on one of the bounding walls leading to an inflatable bladder thereby increasing the pressure in the bladder and strengthening the first coanda attachment bubble, and after the fluid pressure in the bladder reaches a selected level, said attachment bubble begins to get pressurized and the jet is forced to the other of said diverging fluid flow passages.

BRIEF DESCRIPTION OF THE DRAWINGS

The above and other objects and features of the invention will become more apparent when considered with the following specification and accompanying drawings wherein.

DETAILED DESCRIPTION OF THE INVENTION

Figure 1:
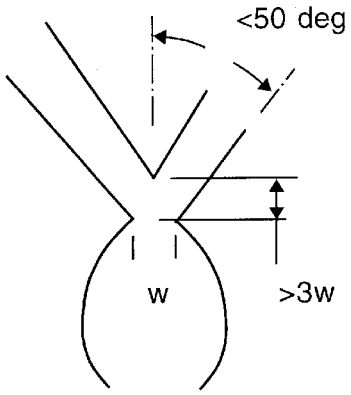
FIG. 1 is a diagrammatic illustration of the upper receiver portion of a normal fluidic crossover switching element.
Figure 2A:
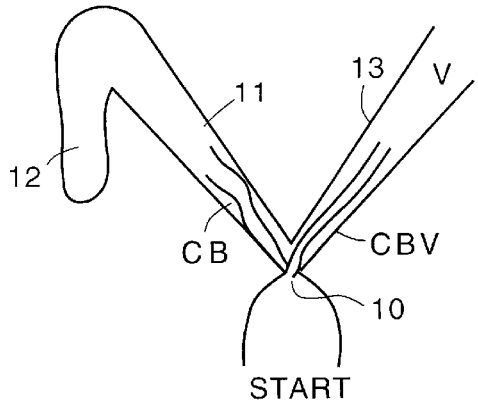
FIGS. 2A, 2B and 2C are diagrammatic illustrations of a one-bladder system which can be configured for inflation performance on one side and the venting on the other side.
Figure 2B:
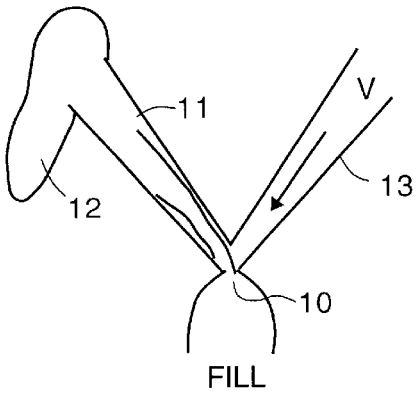
Figure 2C:
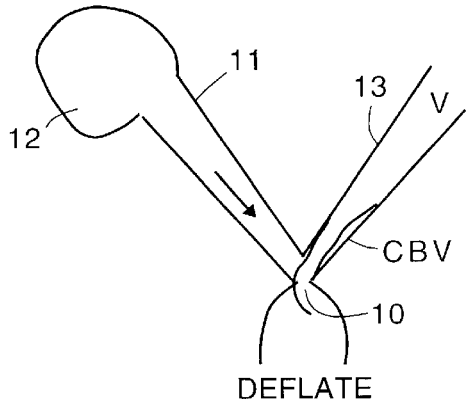
Figure 5A:
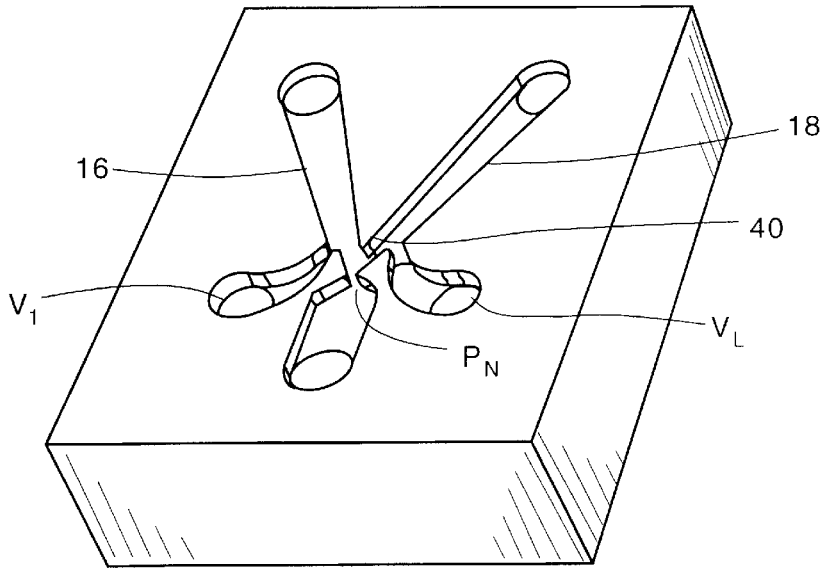
FIG. 5A is an isometric view of a double bladder device incorporating the invention.

Referring to FIGS. 2A, 2B and 2C of the drawings illustrating a one-bladder embodiment, the one-bladder version preferably has a bias of the power nozzle relative to the leg to which the one bladder is connected. Typically, the devices are molded in plastic "chips" (as in FIG. 5A). They can also be made of metal, sintered materials, etc.

Figure 3:
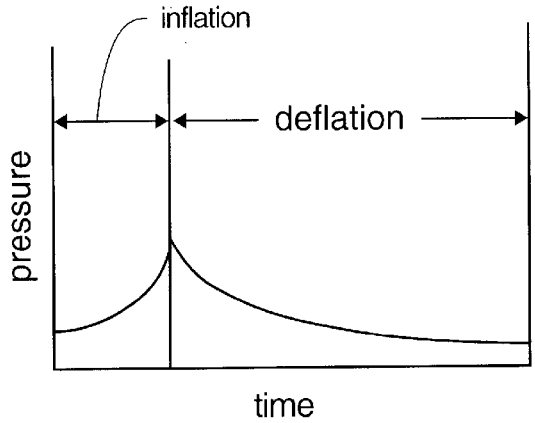
FIG. 3 is a graph of time versus pressure showing the inflation and deflation cycle.

In this case, the power nozzle 10 is biased to the leg 11 containing bladder 12 and leg 13 is vented to atmosphere. In this embodiment, the jet emanating from the power nozzle 10 instantaneously divides between the bladder and the vented receivers at startup and is biased as noted earlier to the leg 11 to the bladder 12. The coanda bubble CB on the bladder side has no opportunity to satisfy its entrainment needs (so it can stably form) since there is no connection to the ambient. However, the coanda bubble CBV on the vented side has ample chance to entrain from the ambient via the vent. The result is the jet attaches to the receiver wall on the bladder side and detaches from the receiver on the vented side. The bladder fills (and the jet entrains some from the vented side) as shown in FIG. 2B until the bladder pressure rises to a point that the attachment is no longer supported and a jet switches to the vented side. The venting continues with the entrainment from the bladder side to aid in deflating the bladder until the differential pressure favors again attachment to the bladder side. The pressure in the bladder verses time such that the inflation/deflation cycle shown in FIG. 3 comprises a fast inflation and a slow deflation. This is more desirable for massaging purposes. In the case of medical cuffs, it is a requirement to have the inflation fast and deflation last for a longer time. This gives the tissue sufficient time to "bounce back."

Figure 4A:
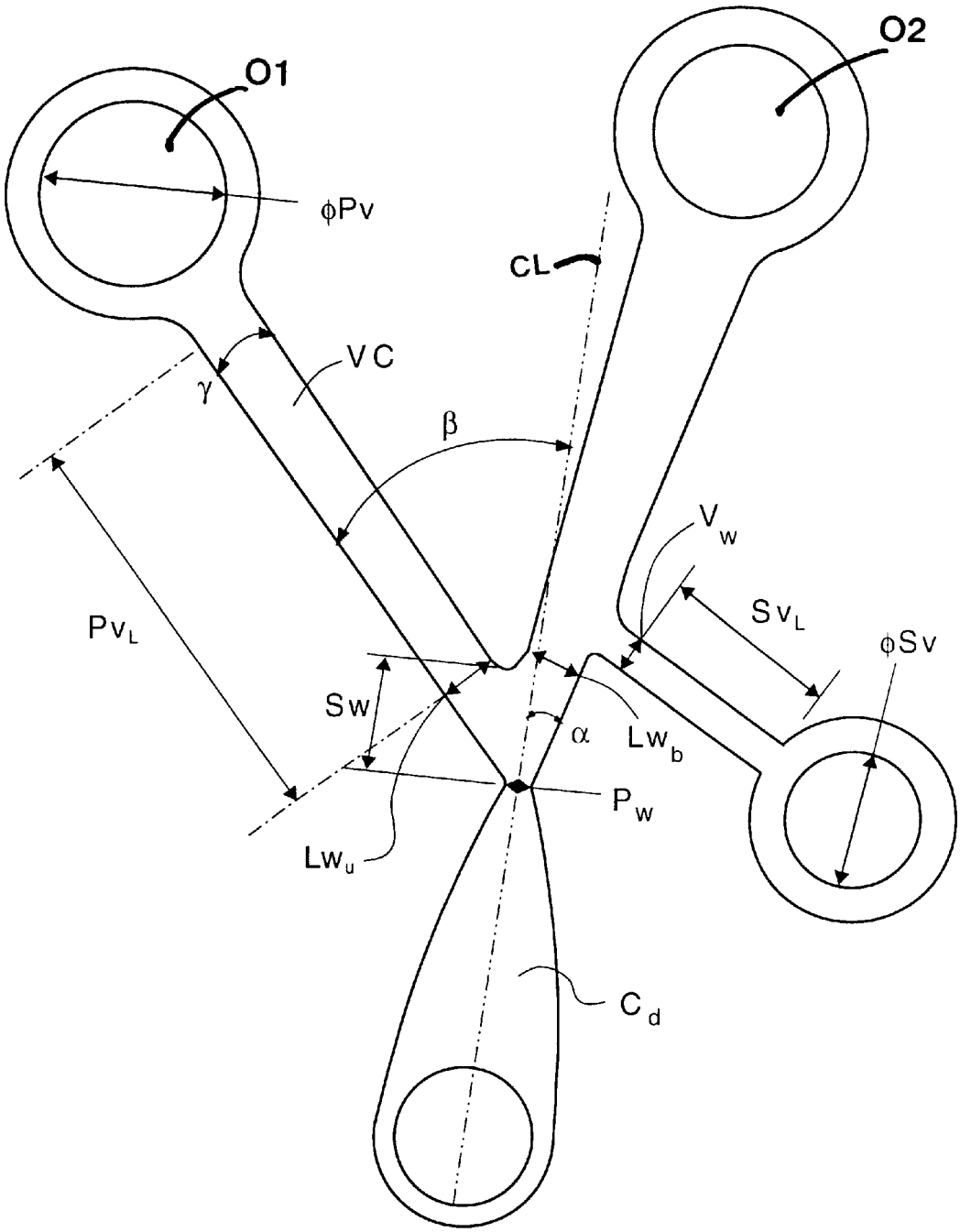
FIG. 4A is a plan view of the silhouette of a preferred embodiment of the single bladder-type device.

Referring now to FIGS. 4A–4G, a preferred embodiment of the single-sided backload fluidic switch is illustrated. In FIG. 4A, note the following:

$\phi$Pv is the vent diameter.

$Lw_u$ is the width of the vent channel.

Pw is the width of the power nozzle.

Sw is the distance from the power nozzle to the splitter.

$\alpha$ is the angle the coanda attachment wall of the side vent makes the centerline CL of the power nozzle.

$\beta$ is the angle the bounding wall of the vent channnel makes the centerline of the CL of the power nozzle.

$\gamma$ is the angle between the walls of the vent channel.

Vw is the width of opening of the vent channel.

$Sv_L$ is the length of the side vent channel.

$\phi$Sv is the diameter of the side vent SV.

$Lw_b$ is the distance between the splitter and the attachment wall.

$Pv_L$ is the length of the vent channel.

Figures 4B, 4C:
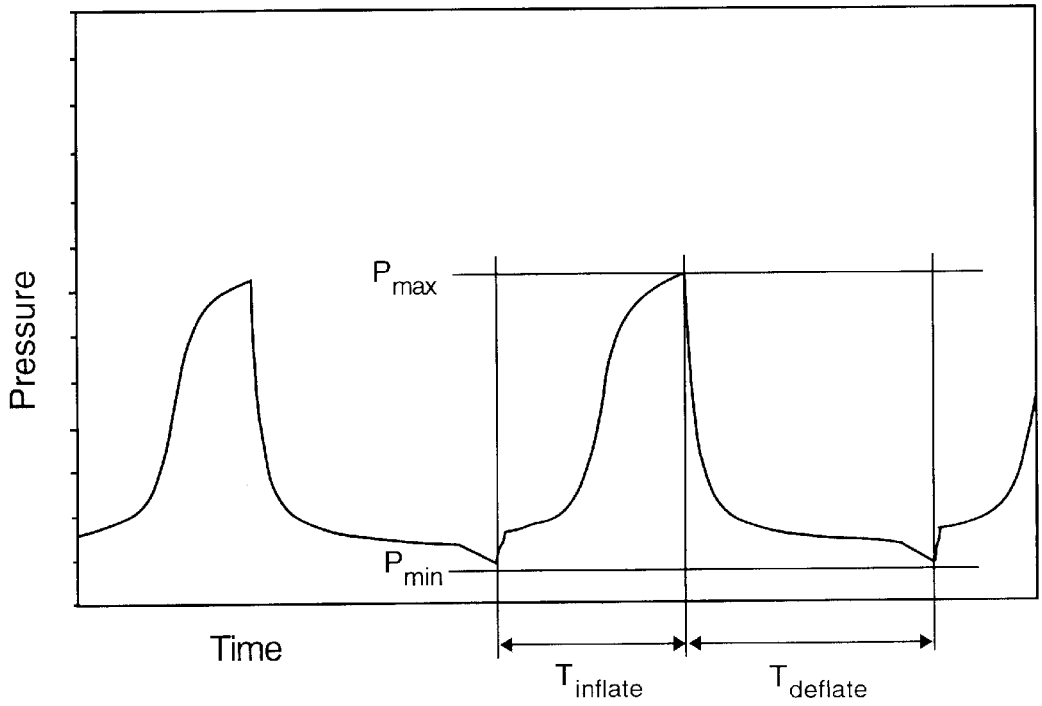
FIG. 4B is a table showing the dimensions of the unit shown in FIG. 4A.
FIG. 4C is a graph showing inflation and deflation cycle.
Figure 4D:
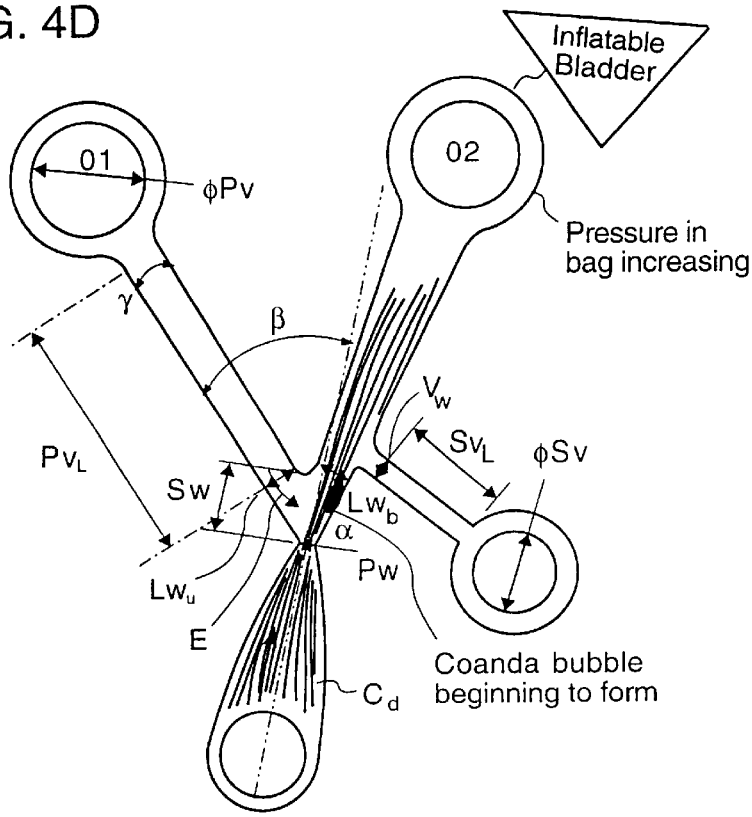
FIGS. 4D, 4E, 4F and 4G are diagrammatic illustrations of the operation of a single-sided backload fluidic switch incorporating the invention.
Figure 4E:
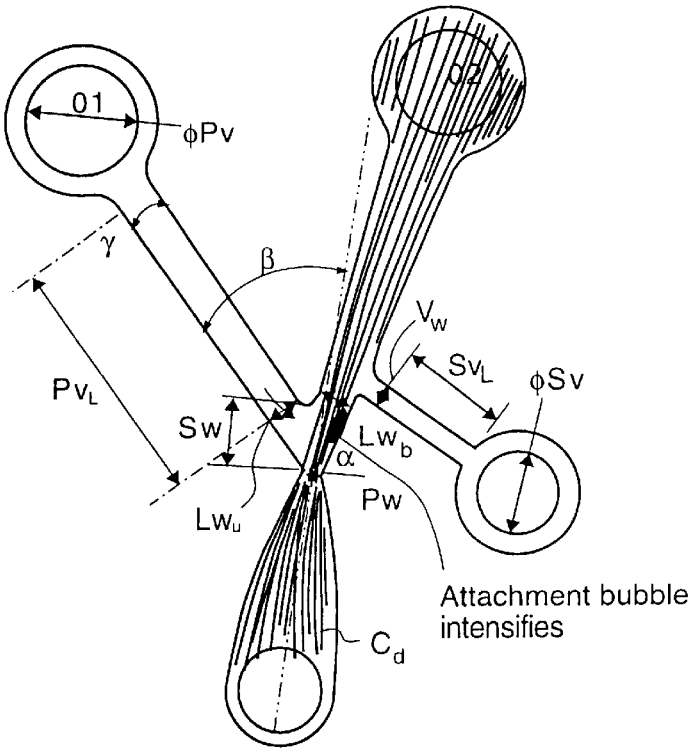

As shown in FIG. 4D, the power nozzle is structurally biased relative to the output 02 to which the inflatable bladder is coupled or attached as shown at startup. Note that the coanda bubble is beginning to form and that there is some entrainment E from the vent side. In FIG. 4E, the inflatable bladder or bag is connected to the output leg 02 and is beginning to fill up and the pressure is increasing in the bag or bladder. It also shows that the attachment bubble is intensifying.

Figure 4F:
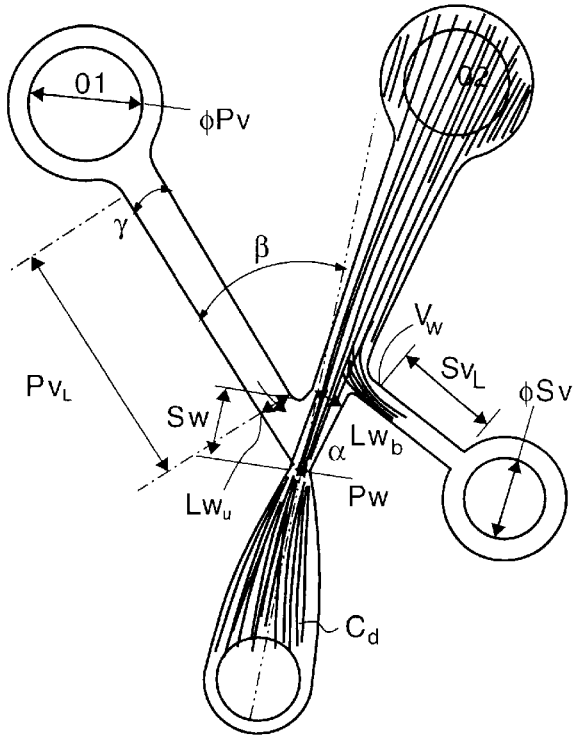
Figure 4G:
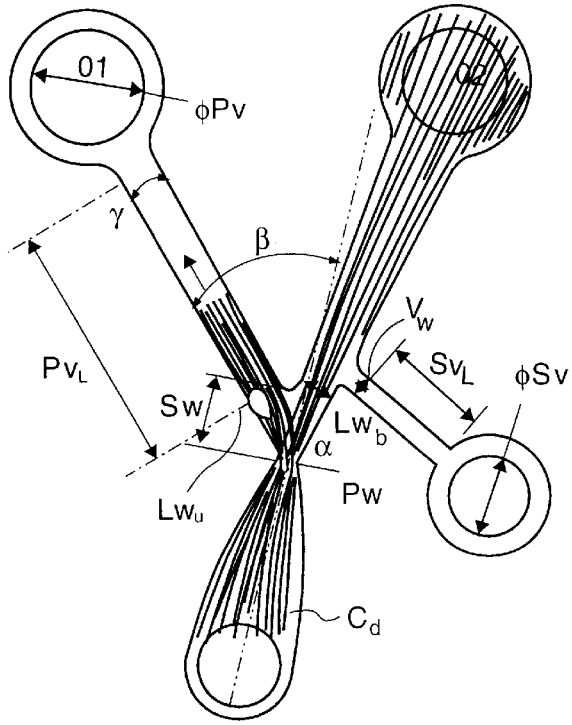

As shown in FIG. 4F, the pressure in the bag or inflatable bladder is now at a point sufficient enough to cause some spill from the auxiliary vent SV. When the pressure in the bag is at a selected level, the attachment bubble begins to get pressurized and the jet is switched to output main vent leg 01 with its own attachment bubble, and entrainment and output leg 02 starts to lower the pressure in the bag enough for the jet to switch back to the leg 02 and the cycle repeats. Thus, the vents provide for optimum operation. The addition and location of the vents basically doubles the pressure recovery. It is possible to achieve up to 80% pressure recovery and even greater. The disclosed units are achieving 65% pressure recovery. Since the fluidic device is always pulling air to create the massaging effect, pressure recovery is very important to minimize energy usage by the system. Previous designs were only able to recover about 25% of the supply pressure. In FIG. 4B, some of the dimensions and preferred values to achieve the specified inflation/deflation times are given. In particular, what has been found is that:

$\phi$Pv, $\gamma$, $\beta$, $Pv_L$ and LWu control the deflation time,

Vw, $\phi$Sv control the inflation time, vent location, size control the pressure recovery.

Figure 5B:
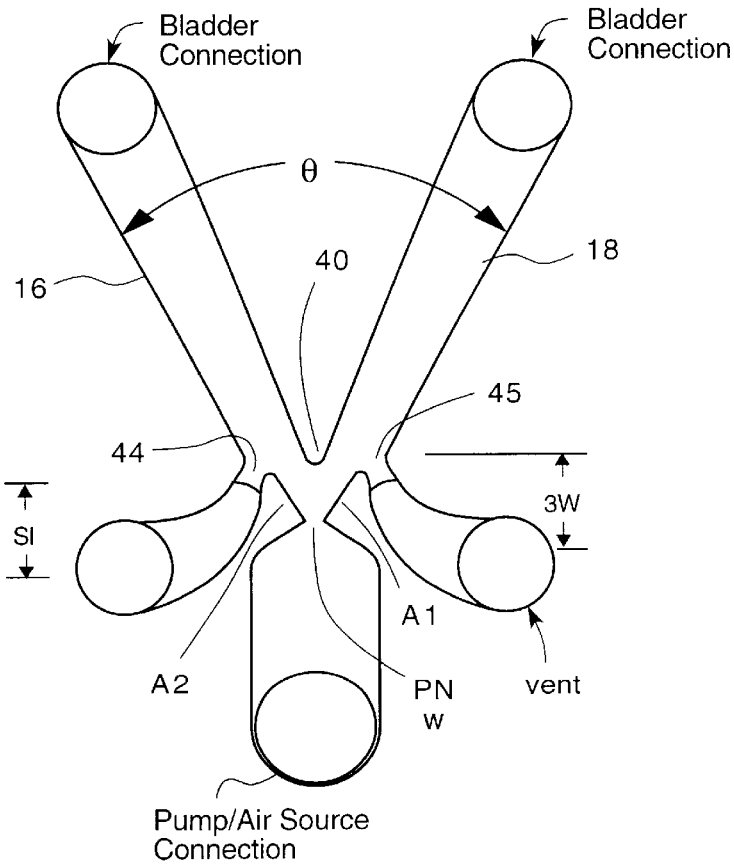
FIG. 5B is a plan view thereof.

In the dual bladder or bag embodiment, each leg is vented. Referring to the fluidic switch shown in FIGS. 5A–5F, it will be noted that it is comprised of a power nozzle PN issuing a jet of fluid (preferably air). A splitter 40 having a spacing of preferably about 3W (W being the width of the power nozzle, 0.020" in the disclosed embodiment) and a wall angle $\theta$ (roughly 40° in this embodiment). The supply channel leading to the power nozzle PN is shaped to minimize pressure losses upstream of the power nozzle. Vents V1 and V2 are located such that it maximizes pressure recovery. In the embodiment shown, the pressure recovery was measured to be about 65%. Prior art devices typically recovered 20% of the supply pressure. To achieve high pressure recovery the vents Sv (FIG. 4A) and V1 and V2 (FIG. 5B) are connected to their respective flow passages at a point beyond the coanda bubble, but as close to the bubble as possible. High pressure recoveries cited above allow the device to fully inflate the bladders or cells, a difficulty encountered by prior art devices, while at the same time allow economic operation at lower supply pressures.

The diverging output channels 16 and 18 result in the downstream end of the vent opening being offset from the upstream end, a geometrical feature that helps in the switching and the deflation of the bags. The size of the vents assists in controlling the deflation cycle and also the peak pressure attained in the inflation cycle. Thus, it is apparent that the illustrated shape, size and location of the vents are important features. Prior art flip-flop type switches required feedback passages to communicate the backload signal to the power jet to cause the switching. The feedback passages also required restrictions to improve the pressure gain of the device, said restrictions resulting in potential manufacturing and operational problems. The fluidic switch of the present invention overcomes this difficulty by eliminating the need for a control passage to effect switching. The splitter 40 defines the receiver passages 16, 18 to the different bladder manifolds BL1, BL2 and each receiver passage 16, 18 is vented 44, 45 to atmosphere by venting passages V1, V2.

Figure 5C:
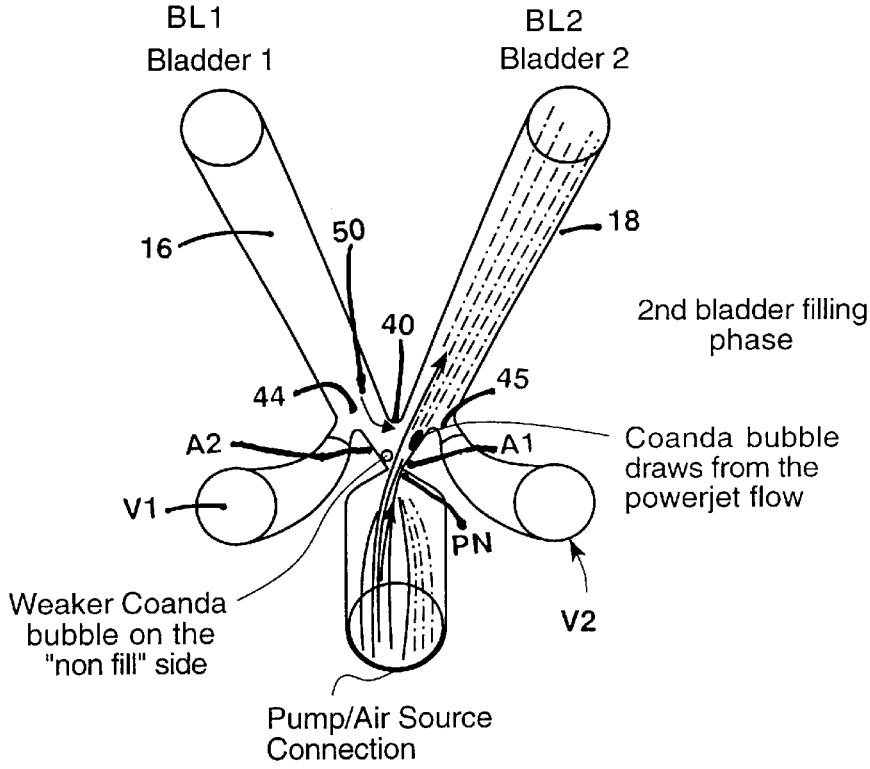
FIGS. 5C–5F are diagrammatic illustrations of the operation thereof.
Figure 5D:
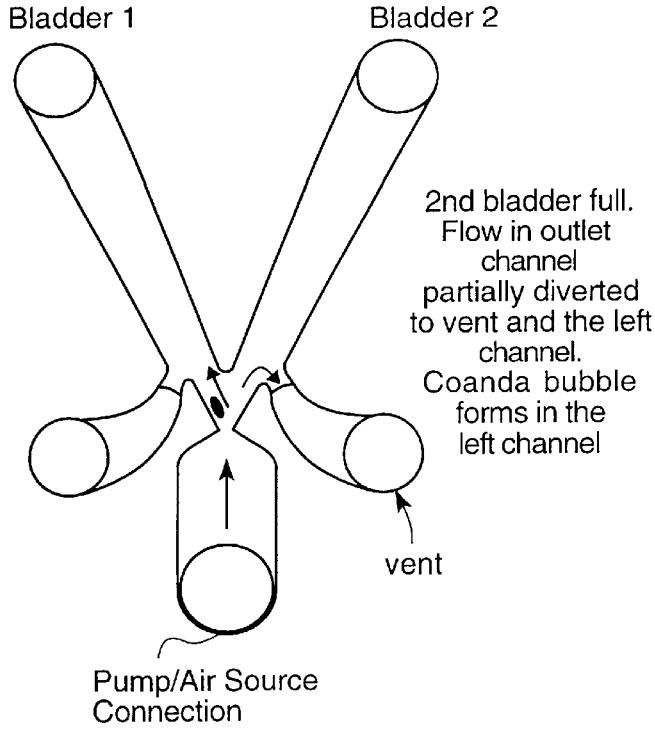
Figure 5E:
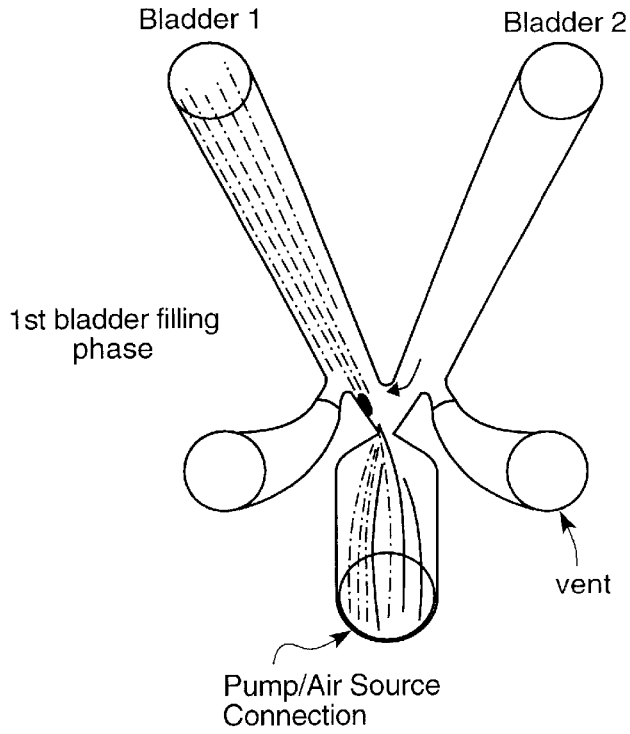
Figure 5F:
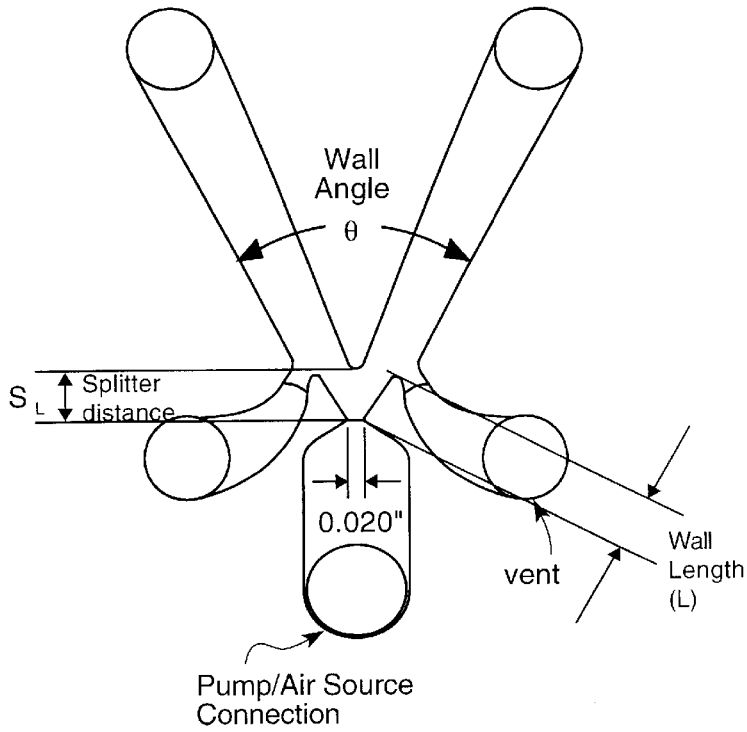
Figure 6:
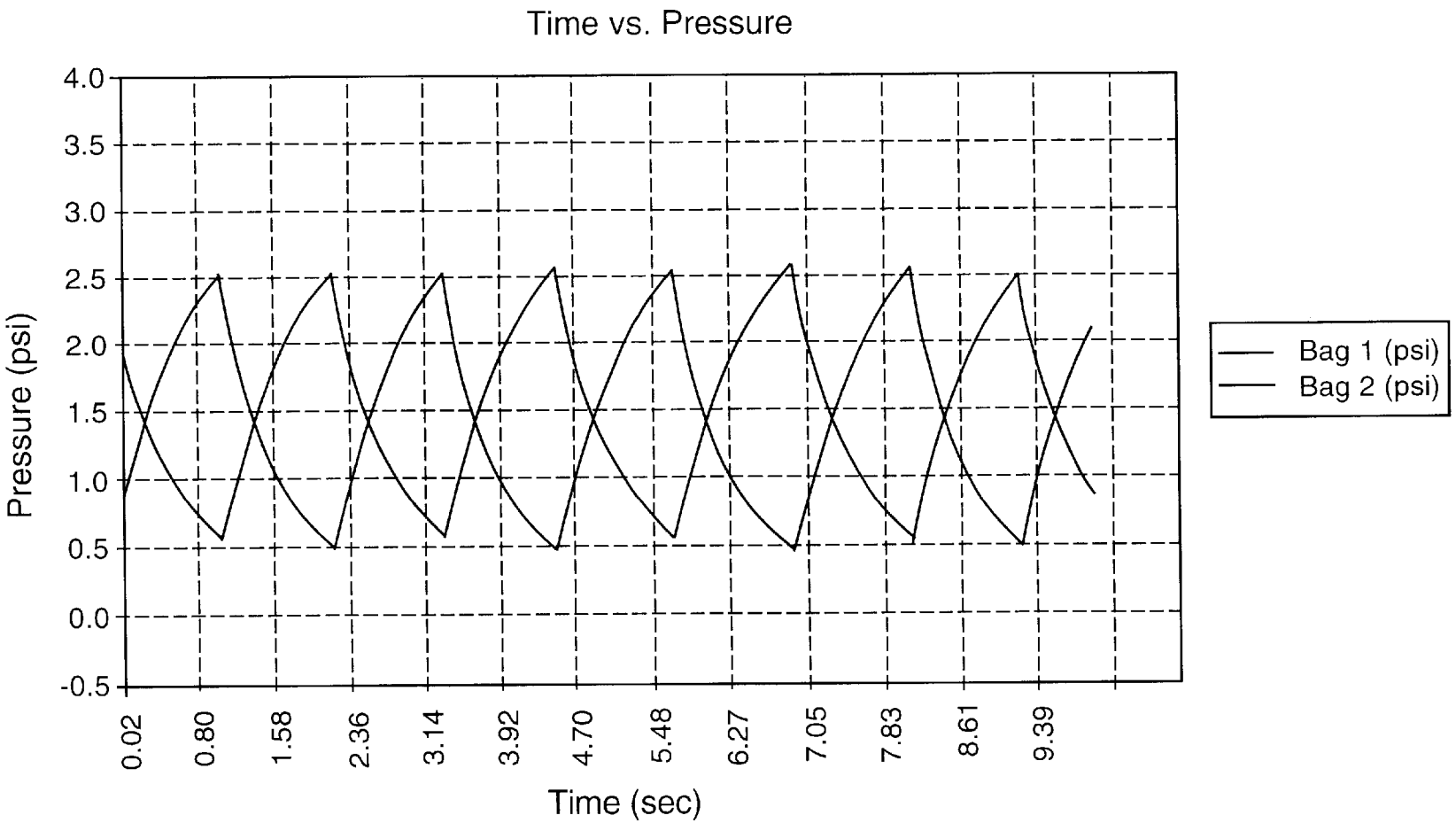
FIG. 6 is a graph of time versus pressure showing the inflation and deflation cycles of the two bladder devices.

Referring now to FIGS. 5C, 5D and 5E, the flow patterns during bladder filling and switching are illustrated. In FIG. 5C, the jet of air is issued through the power nozzle PN and, in the state illustrated, the jet of air is directed into receiver passage 18 and due to the coanda bubble and wall attachment effect attaches to attachment wall A1 with the coanda bubble B1 shown as drawing air from the power jet flowing through receiver passage 18. Entrainment from receiver 16 is indicated by arrow 50. The receiver passage 18 is connected to the manifold BL2 which is connected to fill bladder 2. A weaker coanda or attachment bubble is shown on the non-filled side to receiver 16 and attachment wall A2. In the embodiment shown the wall angle θ is about 40° and the splitter distance SL is about 0.067", the length of the attachment walls A1, A2 is about 3W or 0.060", and the power nozzle W is about 0.020".

When the bladders or cells connected to receiver passage 18 are filled and can receive no more air, the backload overcomes the wall attachment on wall A1 (the coanda attachment) and the flow in the output channel or receiver 18 is partially diverted to the vent V1 (FIG. 5D) and the rest into left channel 16 which then fills bladders 11 via manifold 13. The coanda bubble is formed at the attachment wall A2 in the left channel or receiver channel 16, and the air in bladder 12 exhausts through the vent V1. In FIG. 5D, the bladders 11 are shown as being filled by the jet of air and shows the entrainment of air from the receiver channel 18. When the bladders B1 are fully inflated and can receive no more air and can inflate no further, the backloading pressure in receiver channel 16 overcomes the attachment at wall A2 and causes the reverse procedure to take place.

Thus, in contrast to the steps taken to avoid the effects of backloading on the switch in the Jones patent, the present application takes full advantage of the backload to overcome the wall attachment and cause switching in a simpler fashion.

The fluidic switch as disclosed herein is more robust and allows for a simpler more reliable switching system in that it eliminates the feedback passages as required by the system shown in Jones U.S. Pat. No. 3,390,674.

While the invention has been described in relation to preferred embodiments of the invention, it will be appreciated that other embodiments, adaptations and modifications of the invention will be apparent to those skilled in the art.

What is claimed is:

1. A backload-responsive fluidic switch having high pressure recovery of more than 50% comprises a body member having formed therein:

a power nozzle having a width (W) and a centerline (CL), said power nozzle being adapted to be coupled to a source of fluid under pressure for issuing a jet of fluid along said centerline, a pair of diverging fluid flow passages have a common connection with said power nozzle and respective bounding walls, each respective bounding wall diverging from said centerline no more than about 50°, and a splitter defining respective inner walls of said pair of diverging fluid flow passages, said splitter being spaced a distance of three times said width from said power nozzle, an inflatable bladder connected to one of said diverging fluid flow passages, and a vent connected to the other of said fluid flow passages.

2. The backload-responsive fluidic switch defined in claim 1 wherein there are a pair of inflatable bladders, one connected to each of said diverging flow passages, respectively, and, wherein a pair of vents, one connected respectively to each of said fluid flow passages downstream of said power nozzle, said bounding wall portions between said power nozzle and said vents constituting coanda attachments walls, respectively.

3. The backload-responsive fluidic switch defined in claim 1 wherein said centerline of said power nozzle is offset relative to said one of said power nozzle is offset relative to said one of said diverging fluid flow passages to which said inflatable bladder is connected.

4. The backload-responsive fluidic switch defined in claim 1 wherein said vent is connected to said other flow passage a selected distance from said power nozzle and a portion of said bounding wall from said power nozzle to said vent constitutes a coanda attachment wall.

5. The backload-responsive fluidic switch defined in claim 1 wherein, when said jet of fluid is issued through said power nozzle, said jet of fluid forms a first coanda attachment bubble on one of the bounding walls leading to said inflatable bladder thereby increasing the pressure in said bladder and strengthening said first coanda attachment bubble, and after the fluid pressure in said bladder reaches a selected level, said attachment bubble begins to get pressurized and said jet of fluid is forced to the other of said diverging fluid flow passages.

6. A backload-responsive fluidic switch having high-pressure recovery of more than 50% comprising a body member having formed therein:

a power nozzle having a width (W) and a centerline (CL), said power nozzle being adapted to be coupled to a source of fluid under pressure for issuing a jet of air along said centerline, a pair of diverging fluid flow passages having a common connection with said power nozzle and respective bounding walls, each respective bounding wall diverging from said centerline no more than about 50°, and a splitter defining respective inner walls of said pair of diverging fluid flow passages, said splitter being spaced a distance of three times said width from said power nozzle, an inflatable bladder connected to one of said diverging fluid flow passages, and a vent connected to the other of said fluid flow passages, whereby when a jet of fluid is issued through said power nozzle, said jet of fluid forms a first coanda attachment bubble on the one of said bounding walls leading to said inflatable bladder thereby increasing the pressure in said bladder and strengthening said first coanda attachment bubble, after the fluid pressure in said bladder reaches a set level, said first coanda attachment bubble forces a shift in diverging fluid flow passages.

7. The backload-responsive fluidic switch defined in claim 6 wherein there are a pair of inflatable bladders, one connected to each of said diverging flow passages, respectively, and, wherein a pair of vents, one connected respectively to each of said fluid flow passages downstream of said power nozzle, portions of said bounding walls between said power nozzle and said vents constituting coanda attachment walls, respectively.

8. The backload-responsive fluidic switch defined in claim 6 wherein said centerline of said power nozzle is offset relative to said one of said diverging fluid flow passages to which said inflatable bladder is connected.

9. The backload-responsive fluidic switch defined in claim 6 wherein said vent is connected to said flow passage a selected distance from said power nozzle and the portion of said bounding wall from said power nozzle to said vent constitutes a coanda attachment wall.

10. The backload-responsive fluidic switch defined in claim 6 wherein, when said jet of fluid is issued through said power nozzle, said jet of fluid forms a first coanda attachment bubble on one of the bounding walls leading to said inflatable bladder thereby increasing the pressure in said bladder and strengthening said first coanda attachment bubble, and after the fluid pressure in said bladder reaches a selected level, said attachment bubble begins to get pressurized and said jet of fluid is forced to the other of said diverging fluid flow passages.

11. A backload-responsive fluidic switch having high pressure recovery of more than 50%, said fluidic switch consisting of a body member having formed therein a power nozzle having a width (W) and a centerline (CL), said power nozzle being adapted to be coupled to a source of fluid under pressure for issuing a jet of fluid along said centerline, a pair of diverging fluid flow passages having a common connection with said power nozzle and respective bounding walls, each respective bounding wall diverging from said centerline no more than about 50°, and a splitter defining respective inner walls of said pair of diverging fluid flow passages, said splitter being spaced a distance of three times said width from said power nozzle, at least one of said diverging fluid flow passages being adapted to be connected to a first load device, a first vent connected to one flow passage, a second vent connected to the other of said flow passages, each said vent being connected to its respective flow passage bounding wall downstream of said power nozzle such that portions of said bounding walls between said power nozzle and said vents constitute attachment walls, whereby, when a jet of fluid is issued through said power nozzle, said jet of fluid forms a first coanda attachment bubble on one of the attachment walls leading to a first load device thereby increasing the pressure in the passage leading thereto and strengthening said first coanda attachment bubble, and after the fluid pressure in said first load device reaches a selected level, said attachment bubble begins to get pressurized and said jet of fluid is switched to the other of said diverging fluid flow passages.

* * * * *